US005802818A

United States Patent [19]

Doll et al.

[11] Patent Number: 5,802,818

[45] Date of Patent: Sep. 8, 1998

[54] REFILLING INK JET CARTRIDGES

[76] Inventors: Paul F. Doll, 117 Central St., Apt. E-4, Acton, Mass. 01720; Michael A. Andreottola, 25 Tamarock Ter., Stoneham, Mass. 02180; Shaun Flanagan, 29 Partridge La., Lynnfield, Mass. 01940

[21] Appl. No.: 821,068

[22] Filed: Mar. 20, 1997

Related U.S. Application Data

[63] Continuation of Ser. No. 554,382, Nov. 8, 1995, abandoned.

[51] Int. Cl.[6] ..... B65B 3/04; B65B 3/18

[52] U.S. Cl. ..... 53/468; 53/469; 53/471; 53/486

[58] Field of Search ..... 53/468, 469, 471, 53/486, 289, 390; 141/23, 24

[56] References Cited

U.S. PATENT DOCUMENTS

| | | | |
|---|---|---|---|
| 1,473,342 | 11/1923 | Goldman . | |
| 3,057,131 | 10/1962 | McKinley et al. | 53/88 |
| 3,457,694 | 7/1969 | Tatibana | 53/39 |
| 3,491,803 | 1/1970 | Galik | 53/289 X |
| 3,577,698 | 5/1971 | Ruekberg | 53/37 |
| 3,590,557 | 7/1971 | Vogel | 53/329 |
| 3,625,786 | 12/1971 | Pearson et al. | 53/289 X |
| 3,748,209 | 7/1973 | Pearson et al. | 53/469 X |
| 3,831,240 | 8/1974 | Boggs et al. | 29/148.3 |
| 3,945,174 | 3/1976 | Franz | 53/289 |
| 3,961,626 | 6/1976 | Houchen et al. | 128/145 R |
| 3,973,603 | 8/1976 | Franz | 53/289 X |
| 4,038,667 | 7/1977 | Hou et al. | 346/140 R |
| 4,050,078 | 9/1977 | Isayama et al. | 346/140 R |
| 4,073,294 | 2/1978 | Stanley et al. | 128/278 |
| 4,111,613 | 9/1978 | Sperry | 417/394 |

(List continued on next page.)

FOREIGN PATENT DOCUMENTS

| | | |
|---|---|---|
| 0 437 363 A2 | 7/1991 | European Pat. Off. . |
| 0 456 840 A1 | 11/1991 | European Pat. Off. . |
| 0 567 308 A2 | 10/1993 | European Pat. Off. . |
| 0 568 124 A1 | 11/1993 | European Pat. Off. . |
| WO 94/11195 | 5/1994 | European Pat. Off. . |
| 0 709 205 A2 | 5/1996 | European Pat. Off. . |
| 2 288 148 | 2/1995 | United Kingdom . |
| WO 94/11194 | 5/1994 | WIPO . |

OTHER PUBLICATIONS

Erturk, E., et al. "Ink Retention in a Color Thermal Inkjet Pen" *Hewlett–Packard Journal* 41–44 (Aug. 1988).

*Hewlett–Packard Journal*, p. 27, (Aug. 1988).

Rymal, L. "Recharging Your Deskjet Cartridges" *The Journal of the San Diego Computer Society*, p. 16, (May 1989).

Cowger, B. "The Optimization of Deliverable Ink From a Disposable Print Cartridge" *IS & T's Eighth International Congress on Advances in Non–Impact Printing Technologies* (*1992* ) 312–317.

American Ink Jet Corporation "The 3–Part Refill, Equalize, Replace" (Rev. 3–31–94), instructions that accompany ink jet cartridge refill kit provided by American Ink Jet Corporation.

Platform Development Team "Development of the HP DeskJet 1200C Print Cartridge Platform", *Hewlett–Packard Journal* 46–54 (Feb. 1994).

*Primary Examiner*—Horace M. Culver

*Attorney, Agent, or Firm*—Foley, Hoag & Eliot, LLP

[57] ABSTRACT

An ink jet cartridge is refilled by establishing a fill opening extending from an outer portion of the cartridge into an interior ink bladder of the cartridge, applying pressure to sides of the cartridge to provide a decreased volume of the interior ink bladder, transferring ink into the interior ink bladder through the fill opening while maintaining the decreased volume, sealing the fill opening, and relieving pressure on the sides of the cartridge to provide an increased volume of the interior ink bladder. The fill opening can be established using a poker. Transferring ink can include using a squeeze bottle filled with ink. Pressure can be applied to the sides of the cartridge with a clamp similar to a #100 binder clip manufactured by Office Mate International Corporation of Edison, N.J. The fill opening can be sealed with a set screw or a ball cork along with pressure-sensitive tape.

20 Claims, 4 Drawing Sheets

U.S. PATENT DOCUMENTS

| | | | |
|---|---|---|---|
| 4,123,761 | 10/1978 | Kimura et al. | 346/140 R |
| 4,167,743 | 9/1979 | Corwin | 346/140 R |
| 4,170,016 | 10/1979 | Geil | 346/140 R |
| 4,215,352 | 7/1980 | Corwin | 346/140 R |
| 4,232,702 | 11/1980 | Geil | 137/115 |
| 4,272,772 | 6/1981 | Geil | 346/140 R |
| 4,279,369 | 7/1981 | Passafiume | 225/3 |
| 4,291,317 | 9/1981 | Corwin et al. | 346/140 R |
| 4,305,701 | 12/1981 | Geil | 417/307 |
| 4,329,698 | 5/1982 | Smith | 346/140 R |
| 4,338,765 | 7/1982 | Ohmori et al. | 53/289 X |
| 4,349,129 | 9/1982 | Amneus | 222/41 |
| 4,392,578 | 7/1983 | Fipp et al. | 215/231 |
| 4,475,116 | 10/1984 | Sicking et al. | 346/140 R |
| 4,500,895 | 2/1985 | Buck et al. | 346/140 R |
| 4,509,062 | 4/1985 | Low et al. | 346/140 R |
| 4,518,973 | 5/1985 | Tazaki | 346/140 R |
| 4,558,326 | 12/1985 | Kimura et al. | 346/1.1 |
| 4,597,245 | 7/1986 | Parker | 53/510 |
| 4,607,522 | 8/1986 | Sharp | 73/49 |
| 4,635,073 | 1/1987 | Hanson | 346/1.1 |
| 4,683,481 | 7/1987 | Johnson | 346/140 R |
| 4,714,937 | 12/1987 | Kaplinsky | 346/140 R |
| 4,749,337 | 6/1988 | Dickinson et al. | 417/199.1 |
| 4,794,410 | 12/1988 | Taub et al. | 346/140 R |
| 4,827,294 | 5/1989 | Hanson | 346/140 R |
| 4,867,315 | 9/1989 | Baldwin | 206/558 |
| 4,874,107 | 10/1989 | Arnau-Munoz et al. | 220/20 |
| 4,878,597 | 11/1989 | Haast | 220/404 |
| 4,905,450 | 3/1990 | Hanson et al | 53/469 X |
| 4,931,811 | 6/1990 | Cowger et al. | 346/140 R |
| 4,931,812 | 6/1990 | Dunn et al. | 346/140 A |
| 4,937,598 | 6/1990 | Hine et al. | 346/140 R |
| 4,967,207 | 10/1990 | Ruder | 346/140 R |
| 4,967,209 | 10/1990 | Hasegawa et al. | 346/140 R |
| 4,968,998 | 11/1990 | Allen | 346/140 R |
| 4,973,993 | 11/1990 | Allen | 346/140 R |
| 4,992,802 | 2/1991 | Dion et al. | 346/1.1 |
| 4,998,115 | 3/1991 | Nevarez et al. | 346/1.1 |
| 5,027,872 | 7/1991 | Taylor et al. | 141/347 |
| 5,038,960 | 8/1991 | Seery | 220/403 |
| 5,039,999 | 8/1991 | Winslow et al. | 346/140 R |
| 5,040,001 | 8/1991 | Dunn et al. | 346/140 R |
| 5,126,752 | 6/1992 | Weinberg | 346/1.1 |
| 5,170,609 | 12/1992 | Bullock et al. | 53/434 |
| 5,199,470 | 4/1993 | Goldman | 141/1 |
| 5,280,300 | 1/1994 | Fong et al. | 346/1.1 |
| 5,329,294 | 7/1994 | Ontawar et al. | 397/87 |
| 5,400,573 | 3/1995 | Crystal et al. | 53/468 |
| 5,408,256 | 4/1995 | Keen et al. | 347/87 |

REFILLING INK JET CARTRIDGES

TECHNICAL FIELD

This application is a continuation of application Ser. No. 08/554,382, filed Nov. 8, 1995, and now abandoned.

BACKGROUND OF THE INVENTION

A variety of manufacturers provide computer printers that use an ink jet mechanism to squirt droplets of ink onto paper that is fed through the printer. The ink can be provided in a replaceable cartridge that the user installs in the printer. The ink is delivered to the paper by electrically controlling a printhead portion of the cartridge. Appropriate electrical signals cause printhead electronics to dispense a droplet of ink at a time.

Many manufacturers of ink jet printers also provide the replaceable cartridges. For example, Hewlett-Packard of Palo Alto, Calif. supplies the HP 1200C printer and the cartridge therefor, Model No. HP 51640A. Once all the ink has been used, Hewlett-Packard recommends disposing of the spent cartridge and installing a brand new cartridge purchased from Hewlett-Packard. In most cases, the printhead portion of an empty ink jet cartridge is still usable, but is discarded nonetheless since the manufacturer makes no provision for reusing cartridges. Consequently, the user misses an opportunity to use an otherwise operational cartridge printhead because of the recommendation of the cartridge manufacturer.

It is desirable for the user to be able to refill the spent ink jet cartridge, thus reducing the need to purchase new cartridges. However, the structure and operation of some ink jet cartridges is sufficiently complex so that refilling often involves more than just opening the cartridge up, placing ink inside, and closing the cartridge. For example, many cartridges contain a mechanism for establishing and maintaining a slightly negative internal pressure throughout the life of the cartridge. This slightly negative pressure prevents ink from dripping out of the printhead when the printhead is not being electrically actuated. Accordingly, filling cartridges that maintain a slightly negative pressure requires not only providing ink to the cartridge, but also establishing the slightly negative pressure at the end of the fill operation.

Refilling an ink jet cartridge that operates on a slightly negative pressure principle is shown in U.S. Pat. No. 5,329,294 to Ontawar et al. (the '294 patent) and in PCT Application No. PCT/US93/10988 which is assigned to Graphic Utilities, Inc. of Waltham, Mass. (the Graphic Utilities Application). The cartridges disclosed in both references utilize an equalization bladder to maintain the negative pressure in the cartridge irrespective of the relative atmospheric ambient pressure surrounding the cartridge. Although the equalization bladder is not provided to facilitate refilling, in both references it is used for that purpose in order to establish the initial slightly negative pressure inside the cartridges.

In the case of the Graphic Utilities application, the negative pressure is established after refilling by either pumping air into the equalization bladder after putting the ink in the cartridge or by covering an access hole of the equalization bladder prior to opening the ink cartridge. The '294 patent discloses only pumping the bladder with air after refilling. For both references, the cartridge being refilled corresponds to the Hewlett-Packard 51626A cartridge.

The Hewlett-Packard HP 51640A, C, M, Y, 51644C, M, Y, 51645A, and 51650A, C, M, Y cartridges are described in the February 1994 Hewlett-Packard Journal in an article on Page 46 titled, "Development of the HP DeskJet 1200C Print Cartridge Platform." The cartridge described therein uses a special spring and a bladder mechanism to maintain a slightly negative internal pressure irrespective of the ink level. The ink is maintained inside the bladder. The side covers of the cartridge are made of sheet metal in order to maximize the internal volume and side stiffness of the cartridge while minimizing the overall size. The spring provides a relatively constant force irrespective of its displacement, thus pushing out the sides of the bladder in a manner that establishes a constant negative pressure in the ink storage area throughout the life of the cartridge.

Unlike the 51626A cartridge, the Hewlett-Packard cartridge described in the February 1994 HP Journal and discussed above does not have an access port for an equalization bladder that can be used to establish a slightly negative pressure when the cartridge is refilled. Accordingly, the methods of refilling disclosed in the '294patent and the Graphic Utilities Application are not applicable to the HP 51640 and similar model cartridges. The only external access provided on the cartridge, beside the printhead, is the ink fill access hole which is presumably used by the manufacturer to initially fill the cartridge.

U.S. Pat. No. 5,400,573 to Crystal et al. (the '573 patent) discloses a kit and method for opening, refilling, and sealing an ink jet cartridge similar to the HP 51640 and related cartridges. FIGS. 2A and 2B show the kit 10 comprising a plunger 20, a plate 30, and a spherical plug 40. The plunger 20 is disclosed as being made of a relatively rigid material and including a head 21 at one end and a shank 22 extending along a plunger axis 20*a* from the head 21. The distal end 22*a* of the shank 22 is used to open the refill port of the cartridge.

Although the '573 patent shows an elaborate mechanism for opening the refill hole of the ink cartridge, there is very little discussion as to how to establish the initial negative pressure in the cartridge once the refill operation has been complete. Column 10, Lines 43–46 disclose that the lateral walls of the cartridge can be nominally squeezed together to "pressurize the interior ink storage bladder prior to refilling the cartridge with ink". However, once the plug has been removed from the cartridge and the inside portion of the bladder is exposed to the atmosphere, it is doubtful that squeezing the cartridge will increase the pressure inside the bladder since, with the fill hole open, the pressure in the bladder will equal atmospheric pressure. Accordingly, irrespective of how much "squeezing" is done, the only way to "pressurize the ink storage bladder prior to refilling the cartridge"is to squeeze the cartridge prior to removing the fill plug. However, this will have no effect on the pressure in the cartridge after the refill operation. Furthermore, a pressurized ink storage bladder is undesirable since, as discussed above, the ink jet cartridge works best when the pressure inside the cartridge is slightly less than atmospheric pressure (i.e., when the cartridge is pressurized).

SUMMARY OF THE INVENTION

According to the present invention, an ink jet cartridge is refilled by establishing a fill opening extending from an outer portion of the cartridge into an interior ink bladder of the cartridge, applying pressure to sides of the cartridge to provide a decreased volume of the interior ink bladder, transferring ink into the interior ink bladder through the fill opening while maintaining the decreased volume, sealing the fill opening, and relieving pressure on the sides of the cartridge to provide an increased volume of the interior ink bladder.

Establishing a fill opening can include using a poker to make a hole in a refill plug and to push a ball-cork seal into the interior ink bladder. Transferring ink into the interior ink bladder can include providing a squeeze bottle filled with ink where the squeeze bottle has a neck portion with a diameter less than the fill opening, placing the neck portion into the fill opening, and squeezing the bottle.

Pressure can be applied to the sides of the cartridge with a clamp having pair of jaws that are normally closed by a spring-like force and having a pair of clamp handles, attached to the jaws, for counteracting the spring-like force to open the jaws in response to the clamp handles being moved closer together. The pressure can be applied by moving the clamp handles closer together to provide open jaws, placing the open jaws onto an edge of the cartridge, and releasing the clamp handles. The clamp can be a #100 binder clip manufactured by Office Mate International Corporation of Edison, N.J.

The fill opening can be sealed by providing a set screw having a diameter slightly larger than the fill opening and screwing the set screw into the fill opening. The opening can also be sealed with a ball cork similar to the original ball cork provided by the manufacturer. The ball cork can be made of stainless steel, rubber, plastic, or any other suitable material and is sized to fit snugly into the opening. The opening can be further sealed by applying pressure-sensitive tape over the set screw.

Applying pressure to the sides of the cartridge during the fill operation decreases the volume of the interior ink bladder, thus allowing a slightly negative pressure to be established in the bladder after the fill operation is complete; the fill opening is sealed and the pressure on the sides is relieved to increase the volume of the cartridge. Using a poker facilitates establishing the fill opening by making a hole in the fill plug and pushing the ball-cork seal into the bladder at nearly the same time with a single operation. Using a squeeze bottle with a narrow neck provides ink transfer with a minimum of spillage. Using the clamp with the jaw and handle configuration analogous to that found on the #100 binder clip provides a reliable and consistent pressure to the sides of the cartridge to decrease the volume of the ink bladder an appropriate amount. The set screw and pressure sensitive tape provide a reliable seal and can be easily removed when the cartridge needs to be filled again.

DETAILED DESCRIPTION OF THE PREFERRED EMBODIMENTS

Figure 1:
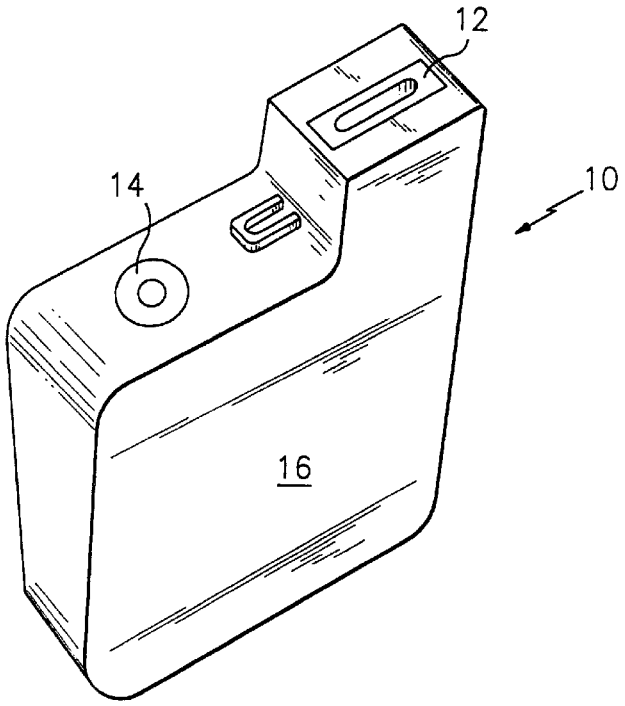
FIG. 1 (PRIOR ART)
FIG. 1 shows a prior art ink jet cartridge corresponding to the HP 51640A family of ink jet cartridges provided by Hewlett-Packard of Palo Alto, Calif.

Referring to FIG. 1, an ink jet cartridge 10 includes a printhead 12, a fill plug 14, and a pair of sidewalls 16, only one of which is shown in FIG. 1. The cartridge 10 corresponds to the cartridge disclosed in the February 1994 article on page 46 of the Hewlett-Packard Journal titled, "Development of the HP DeskJet 1200C Print Cartridge Platform". The fill plug 14 is a flexible piece of plastic attached to the outside of the cartridge 10. As disclosed in the Hewlett-Packard article, underneath the fill plug 14 is a fill hole (not shown in FIG. 1) containing a ball-cork seal (also not shown in FIG. 1). The HP article refers to the flexible piece of plastic used for the fill plug 14 as a "ball seal cover". The ball-cork seal provided in commercially-available versions of Hewlett-Packard's HP 51640 is a metal BB.

Figure 2:
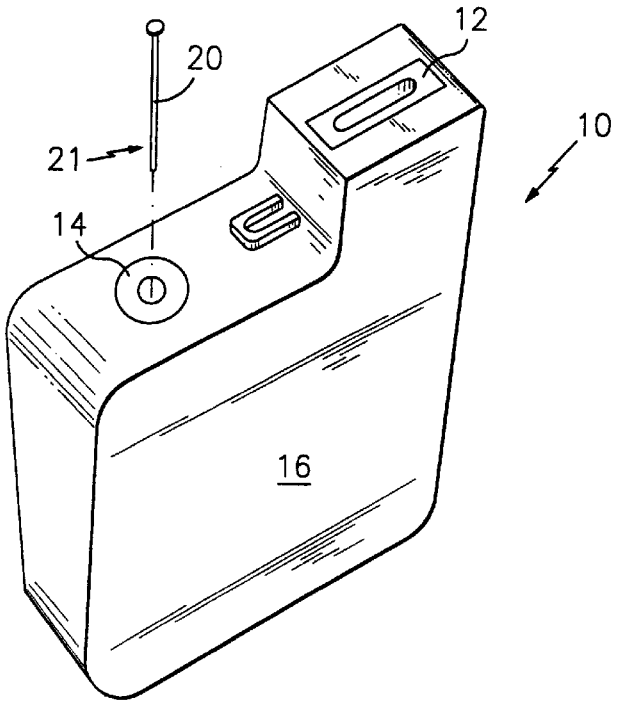
FIG. 2 illustrates creating an opening in the ink jet cartridge.

Referring to FIG. 2, the first step in refilling the cartridge 10 includes using a poker 20 or an equivalent device to push in the plug 14. The poker 20 also pushes the ball-cork (not shown in FIG. 2) into the interior portion of the cartridge 10, as described in more detail hereinafter. The poker 20 can be any relatively rigid elongated object, such as a nail, ballpoint pen, or a specialized tool constructed for that purpose. The diameter of an end portion 21 of the poker 20 is preferably less than the diameter of the hole (not shown in FIG. 2) within the cartridge 10. Only a moderate amount of force is needed to push through the plug 14 and push the ballcork into the cartridge 10.

Figure 3:
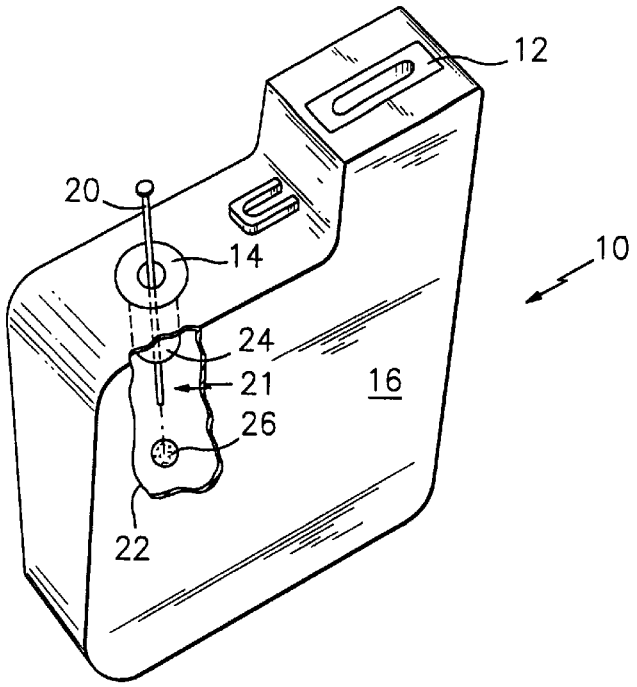
FIG. 3 illustrates pushing in a ball-cork seal of the ink jet cartridge.

Referring to FIG. 3, a cutaway 22 illustrates an internal portion of the cartridge 10. The poker 20 is shown being pierced through the plug 14 and through a hole 24 in the cartridge 10. The hole 24 is provided by the manufacture and is presumably used by the manufacturer to initially fill the cartridge 10 with ink. FIG. 3 also illustrates a ball-cork 26 being pushed through the hole 24 and into the interior of the cartridge 10 by the end portion 21 of the poker 20. The ball-cork 26 remains in the interior portion for subsequent usage of the cartridge 10, but does not affect operation of the cartridge 10. In addition, subsequent refills may be performed in a different manner, as described in more detail hereinafter, depending upon how the cartridge 10 is sealed after refilling.

Figure 4:
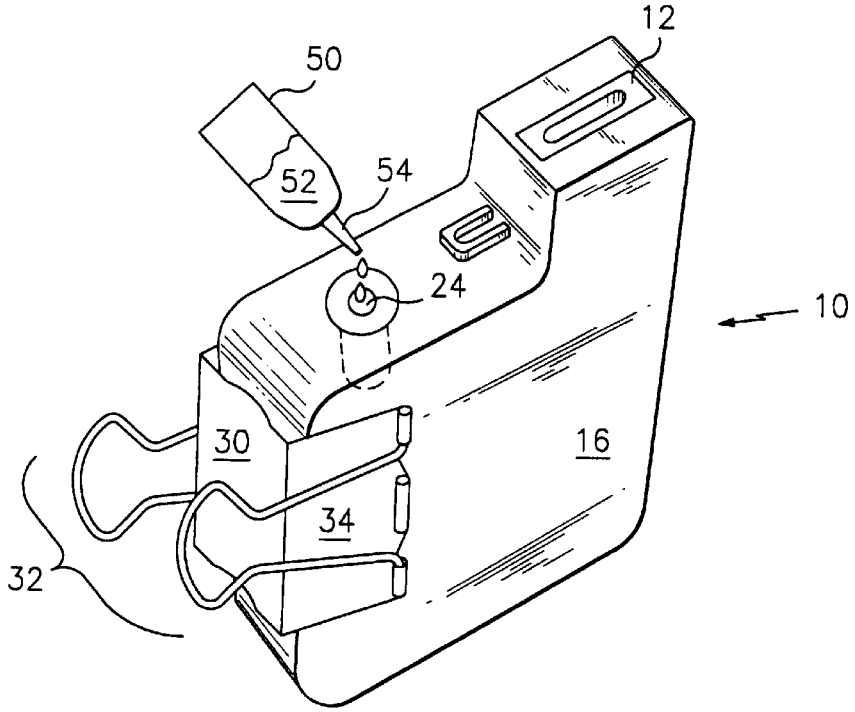
FIG. 4 illustrates clamping the ink jet cartridge and filling the ink jet cartridge with ink.

Referring to FIG. 4, the cartridge 10 is shown with the hole 24 extending to an outside portion of the cartridge 10 after the plug 14 has been poked through by the poker 20 and the ball-cork 26 is pushed into the cartridge 10, as described above. The hole 24 extends into an interior ink bladder (not shown) of the cartridge 10.

FIG. 4 also shows a clamp 30 being placed on an edge of the cartridge 10 and being used to squeeze the sides 16 of the cartridge 10 to decrease the volume of the interior ink bladder of the cartridge 10. The clamp can be a #100 binder clip provided by Office Mate International Corporation of Edison, New Jersey. Other suitable clamps may be used provided that the clamps are capable of providing an appropriate amount of pressure to deflect the sides 16 of the cartridge 10. The clamp 30 includes a pair of clamp handles 32 which are used to actuate the clamp 30. The clamp 30 is opened by moving the clamp handles 32 toward each other to open a pair of jaws 34 (only one of which is shown in FIG. 4) of the clamp 30. The jaws 34 are normally closed by a spring-like force which is counteracted by moving the clamp handles 32 closer together.

The clamp 30 is placed on the cartridge 10 after the hole 24 is made through the casing of the cartridge 10 and before the hole 24 is sealed. Accordingly, the clamp 30 does not increase the pressure of the interior ink bladder. Rather, the clamp 30 decreases the volume of the ink bladder. The pressure of the ink bladder remains at atmospheric, even after the sides 16 of the cartridge 10 are squeezed.

Preferably, the clamp 30 is placed on an edge of the cartridge 10 away from the printhead 12 to minimize the possibility of damaging the printhead 12. However, the clamp 30 can be placed on any usable edge of the cartridge 10 to decrease the volume of the interior ink bladder. The clamp 30 remains on the cartridge 10 during the entire refill operation in order to maintain the decreased ink bladder volume.

FIG. 4 also shows an ink refill bottle 50 containing ink 52 that is to be placed into the cartridge 10. The ink 52 can be any suitable replacement ink, such as ink provided by American Ink Jet Corporation of Billerica, Mass. The ink bottle 50 can be any container suitable for holding the refill ink 52.

The refill bottle 50 includes a long thin extended portion 54 for placing into the hole 24 in the cartridge 10. Preferably, the diameter of the extended portion 54 is less than the diameter of the hole 24. The ink bottle 50 can be a conventional plastic squeeze bottle configured such that when the neck 54 of the bottle 50 is placed into the hole 24 of the cartridge 10, the user squeezes the ink bottle 50 to transfer the ink 52 from the bottle 50 to the interior of the cartridge 10.

Figure 5:
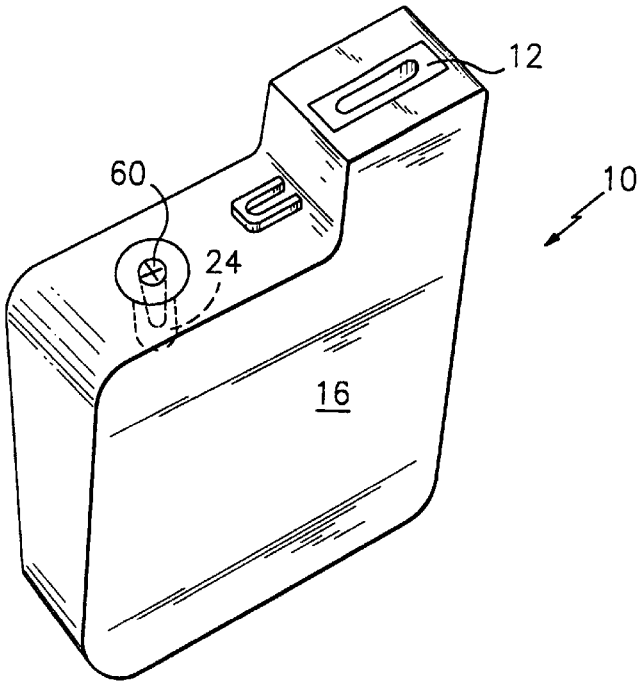
FIG. 5 illustrates using a screw to seal an opening of the ink jet cartridge.

Referring to FIG. 5, the cartridge 10 is shown after it has been filled with the ink 52 from the bottle 50. Prior to removing the clamp 30 shown in FIG. 4, a set screw 60 is screwed into the hole 24. That is, after the ink 52 has been transferred to the cartridge 10, the screw 60 is screwed into the hole 24 prior to removing the clamp 30 from the cartridge 10. Once the screw 60 has been screwed completely into the hole 24, then the clamp 30 is removed from the cartridge 10. The screw 60 can be a conventional self-threading type screw having a diameter slightly greater than the diameter of the hole 24. Removing the clamp 30 causes the sides 16 to spring out slightly, thus increasing the volume of the interior ink bladder. Since the cartridge 10 is sealed by the screw 60, the increase in volume establishes a slightly negative pressure inside the ink bladder.

Figure 6:
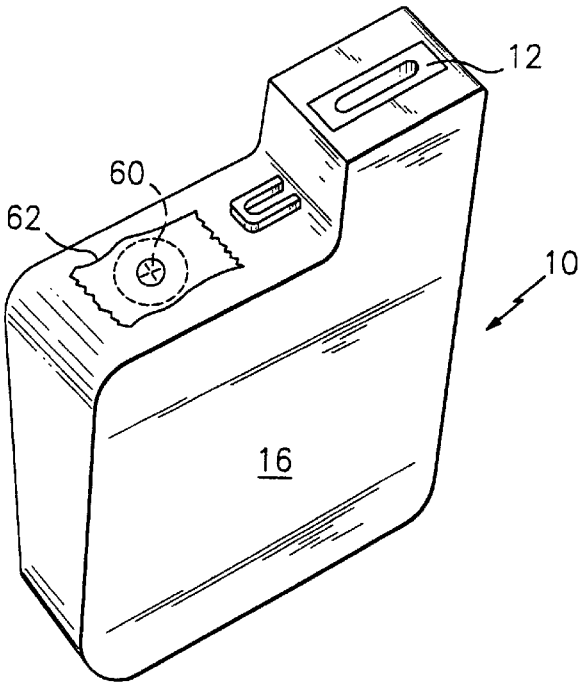
FIG. 6 illustrates using pressure-sensitive tape to provide additional sealing to the opening of the ink jet cartridge.

Referring to FIG. 6, a piece of pressure sensitive tape 62 can be used to cover the set screw 60 in order to provide additional sealing of the cartridge 10 after filling. The pressure sensitive tape 62 can be any conventional pressure sensitive tape such as clear plastic tape or masking tape.

Note that the cartridge 10 shown in FIG. 5 or FIG. 6 is ready to be placed back into the printer for reuse. After filling, the cartridge 10 can be filled again repeatedly by removing the pressure sensitive tape 62, unscrewing the set screw 60 and executing the refill procedure described above in connection with FIGS. 4–6. Note that the cartridge 10 can be used so long as the printhead 12 remains operational. Also note that it is possible to wait to remove the clamp 30 shown in FIG. 4 until after the pressure sensitive tape 62 has been applied to the cartridge 10, since the pressure sensitive tape 62 provides additional sealing, even when the screw 60 does not provide adequate sealing because the screw 60 is slightly loose or askew.

Figure 7:
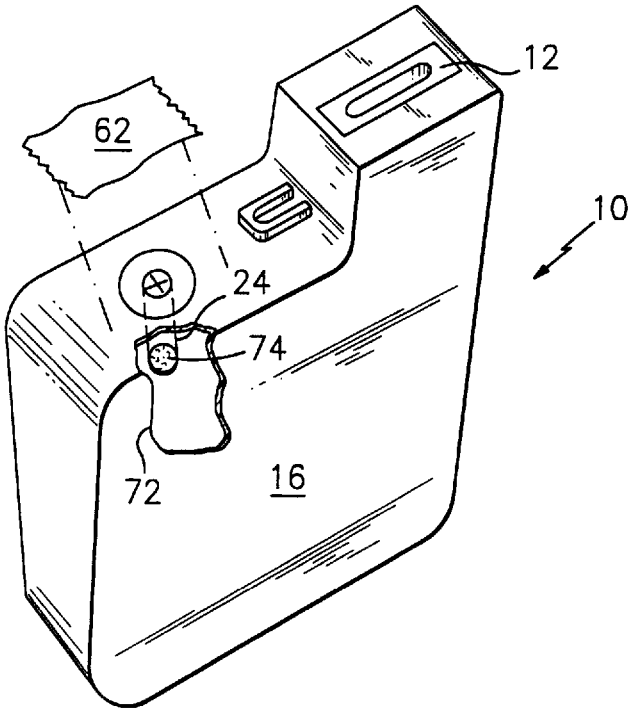
FIG. 7 illustrates using a ball cork and (optionally) pressure sensitive tape to seal the opening of the ink jet cartridge.

Referring to FIG. 7, a cutaway 72 shows the cartridge 10 being sealed with a ball cork 74 similar to the original ball cork 26 provided by the manufacturer and shown in FIG. 3. The user refills the cartridge 10 as described above, but uses the ball cork 74 instead of using a set screw 60 for sealing. The ball cork 74 is substantially spherical and is made of rubber, plastic, stainless steel, or any other suitable material capable of sealing the cartridge 10.

The ball cork 74 is of sufficient size in order to fit snugly in the hole 24. The user can place the ball cork 74 into the hole 24 by using the poker 20, shown in FIGS. 2 and 3, to press the ball cork 72 into the hole 24. Once the ball cork 74 has been placed into the hole 24, the user can apply the pressure sensitive tape 62 to provide additional sealing, as described above. Also, the user can remove the clamp 30 either immediately after the ball cork 74 is inserted or after applying the pressure sensitive tape 62.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. A method of refilling an ink jet cartridge having an interior ink bladder, comprising the steps of:

establishing a fill opening extending from an outer portion of the cartridge into the interior ink bladder;

applying pressure to sides of the cartridge to provide a decreased volume of the interior ink bladder;

transferring ink into the interior ink bladder through the fill opening while maintaining the decreased volume;

sealing the fill opening; and relieving pressure on the sides of the cartridge to provide an increased volume of the interior ink bladder.

2. The method of claim 1, wherein the step of establishing a fill opening includes using a poker to make a hole in a refill plug of the cartridge and to push a ball-cork seal of the cartridge into the interior ink bladder.

3. The method of claim 2, wherein the step of transferring ink into the interior ink bladder comprises the steps of:

providing a squeeze bottle filled with ink, the squeeze bottle having a neck portion with a diameter less than the fill opening;

placing the neck portion into the fill opening; and squeezing the bottle.

4. The method of claim 1, wherein the step of transferring ink into the interior ink bladder comprises the steps of:

providing a squeeze bottle filled with ink, the squeeze bottle having a neck portion with a diameter less than the fill opening;

placing the neck portion into the fill opening; and squeezing the bottle.

5. The method of claim 3, wherein the step of applying pressure to sides of the cartridge comprises the steps of:

providing a clamp having pair of jaws that are normally closed by a spring-like force and having a pair of clamp handles, attached to the jaws, for counteracting the spring-like force to open the jaws in response to the clamp handles being moved closer together;

moving the clamp handles closer to provide open jaws;

placing the open jaws onto an edge of the cartridge; and releasing the clamp handles.

6. The method of claim 5, wherein the step of providing a clamp includes providing a #100 binder clip manufactured by Office Mate International Corporation of Edison, N.J.

7. The method of claim 1, wherein the step of applying pressure to sides of the cartridge comprises the steps of:

providing a clamp having pair of jaws that are normally closed by a spring-like force and having a pair of clamp handles, attached to the jaws, for counteracting the spring-like force to open the jaws in response to the clamp handles being moved closer together;

moving the clamp handles closer to provide open jaws;

placing the open jaws onto an edge of the cartridge; and releasing the clamp handles.

8. The method of claim 7, wherein the step of providing a clamp includes providing a #100 binder clip manufactured by Office Mate International Corporation of Edison, N.J.

9. The method of claim 6, wherein the step of sealing the fill opening comprises the steps of:

providing a set screw having a diameter slightly larger than the fill opening; and screwing the set screw into the fill opening.

10. The method of claim 9, further comprising the step of:

covering the opening by applying pressure-sensitive tape over the set screw.

11. The method of claim 1, wherein the step of sealing the fill opening comprises the steps of:

providing a set screw having a diameter slightly larger than the fill opening; and screwing the set screw into the fill opening.

12. The method of claim 11, further comprising the step of:

covering the opening by applying pressure-sensitive tape over the set screw.

13. The method of claim 6, wherein the step of sealing the fill opening comprises the step of:

placing a ball cork into the fill opening.

14. The method of claim 13, wherein the step of placing the ball cork in the fill opening includes placing a ball cork made of stainless steel, plastic, or rubber in the fill opening.

15. The method of claim 13, further comprising the step of:

covering the opening by applying pressure-sensitive tape over the ball cork.

16. The method of claim 14, further comprising the step of:

covering the opening by applying pressure-sensitive tape over the ball cork.

17. The method of claim 1, wherein the step of sealing the fill opening comprises the step of:

placing a ball cork into the fill opening.

18. The method of claim 17, wherein the step of placing the ball cork in the fill opening includes placing a ball cork made of stainless steel, plastic, or rubber in the fill opening.

19. The method of claim 17, further comprising the step of:

covering the opening by applying pressure-sensitive tape over the ball cork.

20. The method of claim 18, further comprising the step of:

covering the opening by applying pressure-sensitive tape over the ball cork.

* * * * *